US008079187B2

(12) United States Patent
Greiner

(10) Patent No.: US 8,079,187 B2
(45) Date of Patent: Dec. 20, 2011

(54) LINING OF AN IN PARTICULAR FLAT SURFACE WITH A FLEXIBLE COVERING MATERIAL, PARTICULARLY TEXTILE MATERIAL AS WELL AS LINING METHOD

(76) Inventor: Switbert Greiner, Oberaichen (DE)

( * ) Notice: Subject to any disclaimer, the term of this patent is extended or adjusted under 35 U.S.C. 154(b) by 525 days.

(21) Appl. No.: 11/996,534

(22) PCT Filed: Jul. 26, 2006

(86) PCT No.: PCT/EP2006/007401

§ 371 (c)(1),
(2), (4) Date: Aug. 7, 2008

(87) PCT Pub. No.: WO2007/012482

PCT Pub. Date: Feb. 1, 2007

(65) Prior Publication Data

US 2008/0289281 A1 Nov. 27, 2008

(30) Foreign Application Priority Data

Jul. 27, 2005 (DE) ..... 10 2005 035 174

(51) Int. Cl.
*E04B 1/00* (2006.01)

(52) U.S. Cl. ... 52/222; 52/745.05; 52/127.7; 52/506.07; 52/506.08; 160/328

(58) Field of Classification Search ..... 52/506.09, 52/506.08, 506.07, 506.06, 506.05, 222, 52/127.8, 127.7, 328, 327, 22, 745.05; 160/327, 160/328

See application file for complete search history.

(56) References Cited

U.S. PATENT DOCUMENTS 2,950,727 A * 8/1960 Dunn ..... 160/89

(Continued)

FOREIGN PATENT DOCUMENTS

DE 21 66 692 4/1975

(Continued)

OTHER PUBLICATIONS

PCT, International Preliminary Report on Patentability, Completion Date Nov. 12, 2007, pp. 1-8.

(Continued)

*Primary Examiner* — Robert Canfield
*Assistant Examiner* — Jessie Fonseca
(74) *Attorney, Agent, or Firm* — John A. Merecki; Hoffman Warnick LLC

(57) ABSTRACT

The present invention relates to a method for lining an in particular flat surface with a flexible covering material, particularly textile material, in which the surface is lined with one or more flexible covering material pieces and in which the material piece or pieces are stretched. The method is inventively characterized in that for stretching a material piece at least one stretching rail with a holding side and an assembly side is used, that the stretching rail is brought into pivotable engagement on the holding side with a holding rail provided on the flat side, that a first side of the material piece is brought into tensile loadable engagement with the assembly side of the stretching rail, that second side of the material piece is directly or indirectly connected to the flat surface and that the stretching rail is pivoted for stretching the flexible covering material and fixed in a stretching position. The invention also relates to a lining for an in particular flat surface.

30 Claims, 10 Drawing Sheets

U.S. PATENT DOCUMENTS

Figure 1:
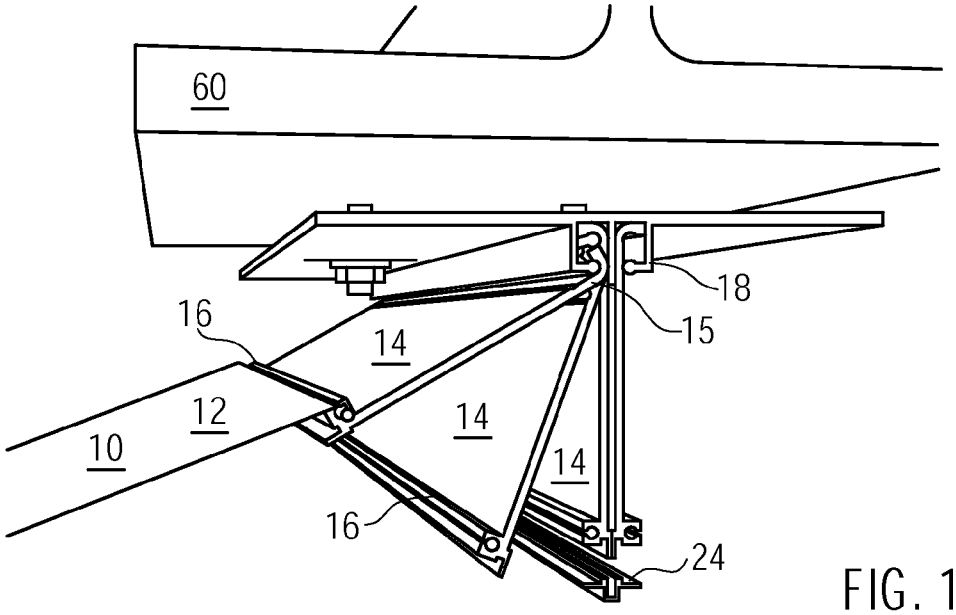

| | | | | |
|---|---|---|---|---|
| 3,508,589 | A * | 4/1970 | Derick et al. | 139/420 R |
| 3,848,380 | A * | 11/1974 | Assael | 52/222 |
| 4,214,407 | A * | 7/1980 | Charter | 52/63 |
| 5,209,029 | A * | 5/1993 | Foerst | 52/63 |
| 5,210,983 | A * | 5/1993 | Kolk | 52/63 |
| 5,242,004 | A * | 9/1993 | Stilling | 160/57 |
| 5,333,425 | A * | 8/1994 | Nickerson et al. | 52/222 |
| 5,979,968 | A * | 11/1999 | Essig et al. | 296/102 |
| 6,789,978 | B1 * | 9/2004 | Yoshinari | 403/381 |
| 2002/0152704 | A1 * | 10/2002 | Thompson et al. | 52/506.06 |
| 2004/0168383 | A1 * | 9/2004 | Reynolds et al. | 52/273 |
| 2004/0182022 | A1 * | 9/2004 | Stackenwalt et al. | 52/222 |

FOREIGN PATENT DOCUMENTS

| | | | |
|---|---|---|---|
| DE | 33 29 542 | A1 | 2/1985 |
| DE | 199 59 254 | C1 | 5/2001 |
| EP | 1 271 456 | A2 | 1/2003 |
| GB | 2 382 712 | A | 6/2003 |
| WO | WO 03/083812 | A2 | 10/2003 |
| WO | WO 2004/044874 | A1 | 5/2004 |

OTHER PUBLICATIONS

PCT/EP2006/007401, International Search Report, pp. 1-6, Completion Date Nov. 23, 2006.

* cited by examiner

LINING OF AN IN PARTICULAR FLAT SURFACE WITH A FLEXIBLE COVERING MATERIAL, PARTICULARLY TEXTILE MATERIAL AS WELL AS LINING METHOD

The present invention in a first aspect relates to a method for lining an in particular flat surface with a flexible covering material, particularly a textile material. In a second aspect the invention relates to a lining, cladding or facing of an in particular flat surface with a flexible covering material, particularly a textile material.

In such a method the surface is lined with a material piece or several material pieces of the flexible covering material and the material piece or the several material pieces are stretched. Such a lining has one or more pieces of the flexible covering material.

Such linings are used in the architecture sector, e.g. for lining the ceilings or roofs of large, high halls or hangers.

A method and a lining of this type are known from DE 38 30 576 A1. The covering material, called a membrane therein, is here clipped between a plurality of clipping plates and is e.g. fixed with the aid of screw couplings. The stretching and fixing e.g. at a considerable height or on long ridges or edges is complicated and therefore expensive in this conventional method where screwed or clipped connections are used. It is also impossible or only possible with considerable effort and cost, to stretch longitudinally and transversely to the edge or border. However, biaxial stretching is the prerequisite for freedom from creases.

Lining of the aforementioned type are also described in DE 33 29 542 A1, DE 23 06 727, U.S. Pat. No. 6,164,364 and DE 199 59 254 C1.

The object of the invention is to provide a lining of surface and a method for the same, where also large surfaces can be lined in an uncomplicated and rapid manner.

According to the invention the method of the aforementioned type is further developed in that for stretching a material piece use is made of at least one stretching rail with a holding side and an assembly side, that the stretching rail is brought into pivotable engagement on the holding side with a holding rail provided on the surface, that a first side of the material piece is brought into a tensile loadable engagement with the assembly side of the stretching rail, that a second side of the material piece is tensile loadably connected either directly or indirectly with the surface and that the stretching rail is pivoted for stretching the flexible covering material and fixed in a stretching position.

The lining of the aforementioned type is inventively characterized in that for stretching the covering material stretching rails are provided on which there are in each case a holding side and an assembly side, that in each case the holding side of the stretching rails is brought into pivotable engagement with a holding rail provided on the surface, that the stretching rail can be fixed with respect to the holding rail in a stretching position, that a first side of a material piece can be brought into tensile loadable engagement with the assembly side of stretching rail, that a second side of the material piece can also be brought into tensile loadable engagement directly or indirectly with the flat surface and that by pivoting the stretching rail and fixing the stretching rail in the stretching position it is possible to produce a stretching state of the flexible covering material.

The first fundamental idea of the invention is that the stretching process for a material piece is performed so-to-speak in situ on an already prefitted material piece. It has been recognized in the invention that this can be implemented particularly easily if to one side of the material piece is connected a plate, referred to as a stretching rail here, which is pivotably located on the surface to be lined. By simply pivoting the plate the material piece, which is directly or indirectly connected in tension-proof manner to the surface to a further, e.g. facing side, is stretched. The stretching rail is then in a fixable stretching position. In order that said stretching state can be implemented, the material piece must have a suitable size.

By means of this innovative assembly concept for flat textile surfaces numerous advantages are achieved compared with the prior art. As the stretched state is brought about by simply folding round or pivoting stretching elements, particularly rapid assembly is possible. As the stretching rails can be made in principle also very large, this can be achieved with considerably reduced personnel employment compared with the prior art. With the aid of suitable tools for pivoting the stretching rails it is also possible to adapt readily and unexpensively to the existing circumstances of the building site, particularly in the case of linings at a considerable height and in the case of ground plans having large openings.

As there is no need for complicated fixing and stretching of the membrane using clipping means and screw connections, the covering material can also be positioned in biaxially, crease free manner, with narrow and precisely straight edges.

Another important idea of the present invention is that the covering material is connected to the stretching rails in such a way that during stretching it can move relative to the stretching rail in a longitudinal extension direction of the latter. This makes it possible to particularly easily implement biaxial or two-dimensional stretching, i.e. stretching in both a transverse and a longitudinal direction.

By means of the method according to the invention even very large, prefabricated membrane elements can be speedily brought onto the surface to be lined, e.g. from floor to ceiling. There, the large membrane element can be positioned, stretched and fixed there in a short time. A significant improvement compared with the prior art is provided in that in the inventive method stretching and fixing no longer hinder one another. Lengthenings resulting from the stretching process and which is inherent with movements and deformations and which then occur at the fixing points are not impeded. Particularly in the case of the clip connections as described in the prior art where lengthening in the direction of the edge is virtually impossible during stretching or at least leads to creasing, such biaxial stretching is impossible.

It is also advantageous that in the method and lining according to the invention the hitherto necessary, particularly time-intensive screw couplings are unnecessary.

In the inventive method the functions installation, stretching, fixing and covering are integrated. High speed and functionality are particularly achieved through the speed during positioning as a result of the threading of the material piece in a welt profile, by the screwless holding of the membrane during installation and by particularly easy stretching, especially in two directions, as a result of the specific inventive mechanism, whose essential component is a stretching rail. The method steps of positioning, stretching and fixing do not impede one another and a rapid, screwless fixing in the stretched state is possible. With the aid of a clipping profile an existing joint can be cleanly and rapidly covered. There results only a butt joint of minimum width between two adjacent portions or areas.

For example, an installation of very large ceiling elements with dimensions of roughly $10\times50$ m$^2$ in a height of roughly 10 m is readily possible.

A particular advantage of the method and lining according to the invention is that the positioning, stretching and fixing of the respective material piece can take place without any mutual hindrance. This also obviates the need for the hitherto necessary and time-consuming holding of the material piece in the correct position prior to fixing, especially overhead and at a significant height. From the mechanical standpoint considerable advantages are achieved, because there is no need for clips and/or screws through which the covering material could be possibly perforated and certainly weakened.

Through the fixing of the stretching rail in a clearly defined stretching position predetermined by the characteristics of said stretching rail and the holding rail, there is particularly well defined positioning of the material piece edge, which is not possible with spring clips.

In principle, the lining and method according to the invention are suitable for random surfaces. However, the advantages of the invention become particularly clear with flat surfaces, e.g. when lining walls or ceilings. The inventive method in particular makes it readily possible to line large roofs, e.g. of large halls, also at a considerable height.

The pivoting axis of the stretching rail can be oriented at random, but preferably is essentially along, i.e. parallel to the surface to be lined.

In principle, prior to assembly the stretching rails can be connected on the surface to be lined with the given material piece. However, in especially preferred manner first the stretching rails are firstly brought into pivotable engagement with the holding rails on the surface to be lined. The fitting of the material piece is particularly simple in this case, because it only has to be fitted to the stretching rails present on the surface to be lined, e.g. on a ceiling. As stretching only takes place subsequently, this operation is not subject to high precision requirement and can therefore be rapidly performed.

The holding rails can already be integrated into the surface to be lined, e.g. the ceiling, or can be in the form of separate components.

In a particularly preferred variant the tensile loadable engagement of the material piece and stretching rail is a back engagement. Such a connection can be rapidly made and released again.

From the production standpoint such a back engagement can be implemented if the covering material piece is provided with a welt and the stretching rail with a corresponding groove, particularly an annular groove. The welt is e.g. a bead or bulge-like thickening of the edge of the covering material. Preferably such a welt has a round cross-section.

Good characteristics regarding handling and mechanical cooperation with the covering material and stretching rails can be achieved if the welt is made from a tension-proof, flexible material, especially a strand, braid or plastic wire. With regards to an extensive freedom from creasing of the covering material the welt material is preferably so chosen that on tensile loading the welt is essentially deformed in the same way as the covering material.

From the method standpoint the covering material can be drawn into the stretching rails already located on the surface to be lined, but which can still be pivoted. This can be implemented rapidly, with limited personnel demands and in particular also readily at considerable height.

For drawing in purposes a cable can e.g. be used. If e.g. a ceiling is to be lined, this advantageously can also take place from the floor, e.g. a steel cable can be used. The cable, which can also be called a threading strand, is preferably already incorporated into the holding rails. Preferably the steel threading strand has a diameter of approximately 3 mm and is in each case equipped with coupling pieces, so that the strand portions of linking holding rails can be joined to one another.

Large surfaces can be particularly rapidly and effectively lined if the material pieces are constituted by covering material webs. The term "web" means a substantially rectangular material piece, where the length greatly exceeds the width. Such a web can e.g. have dimensions of $10\times50$ m$^2$.

The covering material is preferably a textile material, especially lighting fabric or a film or foil. With respect to the fitting or installation textile materials have special advantageous characteristics and can also be obtained according to widely varying specifications. The term lighting material or fabric is understood quite generally to mean fabrics having specific optical characteristics. This term particularly covers fabrics through which in planned manner a particularly high light scattering is achieved without significant intensity being lost. The covering material or membrane can e.g. have a specific gravity or weight of approximately 100 to 400 g/m$^2$. The resulting vertical forces can be absorbed by the stretching rails and holding rails, especially through a locking mechanism.

To obtain a maximum crease-free installation state the material piece is preferably chosen somewhat smaller than the surface actually covered in the stretching state, i.e. the material piece is lengthened during stretching. A good, crease-free assembly state, accompanied by not excessive stretching forces is brought about with typical fabrics if the material piece is dimensioned regarding length and width in each case 1 to 5%, preferably 1% smaller than in the lengthened installation state.

The stretching rails are preferably made from a light metal, especially aluminium. They can e.g. be aluminium extruded sections. Preferably the annular groove of the stretching rails are designed internally smooth to improve the sliding through of the welt. For optical reasons and also to facilitate the sliding through of the material piece welt, the aluminium stretching rails can have an anodic treatment.

The aforementioned fundamental idea of the invention is already implemented if in the case of a material piece joined in tension-proof manner to one side of a surface to be lined in some way is stretched to a further, particularly facing side with the aid of a stretching rail to be pivoted into a stretching state. However, preferably stretching rails are provided on at least two facing sides, particularly on all sides of the material piece. For example, in the case of a rectangular material piece, e.g. a web in the aforementioned sense can be provided on all four sides with stretching rails.

A crease-free, smooth covering material surface can then be easily brought about in that the covering material is stretched in both a longitudinal and a transverse direction and this is referred to as biaxial stretching.

Fundamental freedoms exist concerning the specific procedure. Particularly if the material pieces are textile webs, it is particularly advantageous for the covering material to be firstly longitudinally and then transversely stretched. Preferably the front faces of the webs are provided with the in each case necessary stretching rails, which are then inserted in the holding rails present on the surface to be lined.

Basically, it can be adequate for stretching rails to be provided only on specific portions of the material piece. However, a particularly crease-free covering material surface which remains crease-free is obtained if stretching rails are provided over the entire material piece length.

Freedoms of choice also exist regarding the specific construction and choice of stretching position. Thus, the pivoting movement can in principle take place by almost 180° and the covering material in the stretching state is then in the direct vicinity of the surface to be lined. However, particular preference is given to a variant in which the stretching rails are constructed for in particular uniformly spaced holding of the covering material with respect to the flat surface. In the stretching position the stretching rails are then preferably transverse to the surface to be lined. An arrested stretching position can in this connection be achieved in that the stretching rails and holding rails are designed for a locking, rotation-fixed connection.

From the method standpoint this can be readily achieved in that the holding rails are provided with a resilient leg having a bulge or bead and the stretching rails are provided with correspondingly shaped recess, so that on pressing the stretching rail at right angles to the pivoting axis the locking, rotation-fixed connection is provided.

Particular advantages arise in this connection if the holding rails are constructed for the adjacent reception of two stretching rails. This can in particular take place through a substantially mirror symmetrical design of the holding rails. The holding rails can compensate possible differential forces occurring through a fundamentally possible, different stretching in adjacent material pieces.

An optical covering and mechanical connection can be achieved in this connection if two adjacent stretching rails are covered and fixed in the stretching position by a covering profile. This covering profile is preferably so constructed that it can be fixed in locking manner to the stretching rails. This permits an easy and rapid assembly and therefore also a problem-free disassembly.

The embodiment according to the invention described in the preceding two chapters essentially relating to holding rail able to receive two adjacent stretching rails is claimed independently of the invention described in the claims together with the aforementioned generic method and lining.

A complete lining of a corner area in which a front face and a longitudinal side abut, can be brought about in uncomplicated manner by the following method step. Firstly a frontal stretching rail portion is fitted, followed by a stretching of the material piece in the longitudinal direction. The assembly of the frontal stretching rail portion can also take place at this stage. Following on to this the material piece is stretched transversely and a frontal welt of the material piece slides into the frontal stretching rail portion. The corner region is then closed in that a longitudinal side stretching rail portion is introduced transversely following stretching. Thus, from the optical standpoint nearly perfect linings of corner regions can be brought about.

A particularly reliable working is made possible if for the outwardly directed force-free forcing in of the stretching rails into the holding rails use is made of a forcing in tool with a pressing device, the latter being supported on an abutment provided in the holding rails and the stretching rails to be forced in. For this purpose the holding rails can be equipped with an abutment with which the processing device of the forcing in tool can be brought into a supporting, e.g. back engagement.

The functionality of such a forcing in tool can be increased and then said forcing in tool can be called a pressing-drawing tool, if for the outwardly directed, force-free drawing out of the stretching rail from the holding rails use is made of such a pressing-drawing tool with a pressing-drawing device where, for drawing out with the stretching rails, the said pressing-drawing device can be brought into a back engagement. This can e.g. be brought about in that the stretching rails have on theirs assembly sides profilings, particularly bulges, with which the pressing-drawing tool can be brought into a back engagement for drawing out the stretching rails. These bulges can also be used for the locking reception of a covering profile.

Sprinklers and smoke dampers can easily be integrated into the inventive lining. For example, a sprinkler with housing can already be installed in the roof structure. The sprinkler head can then be unscrewed and when the membrane is fitted and stretched beneath the sprinkler bell clamping rings can be fixed through the membrane with screw to the bell, so that the membrane is firmly fixed. By removing the membrane material, e.g. by cutting out, the sprinkler bell can then be exposed.

An installation of smoke dampers can easily take place by means of lightweight auxiliary supports installed in a preparatory step and on which are already pre-installed e.g. a lighting membrane. The membrane is then clamped and cut out on the edges of the dampers, in the form of frames covered with the stretched covering material. The dampers can then be fixed to hinges and equipped with suitable actuators. These actuators or operation devices for the smoke dampers are controlled by smoke sensors and open the dampers in the case of a fire. It is also easily possible to integrated fans into such a ceiling structure.

Further advantages and characteristics of the method and lining according to the invention are described hereinafter relative to the attached drawings, wherein show:

FIG. 1 A perspective partial view of a first embodiment of an inventive lining with different pivoting states of a stretching rail.

Figure 2:
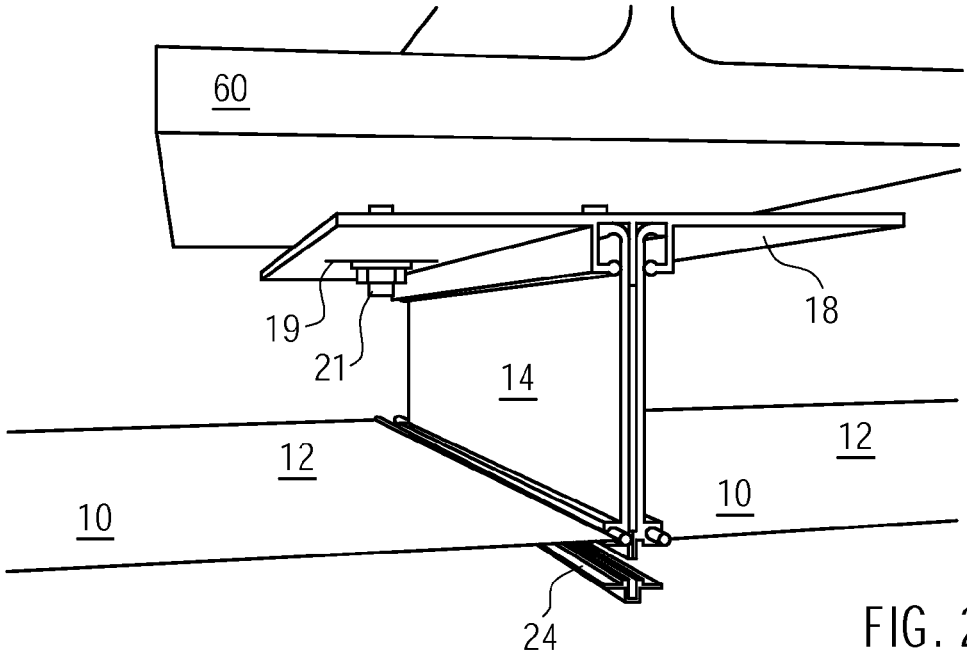

FIG. 2 Another perspective partial view of the embodiment of FIG. 1 with two stretching rails in the stretching position.

Figure 3:
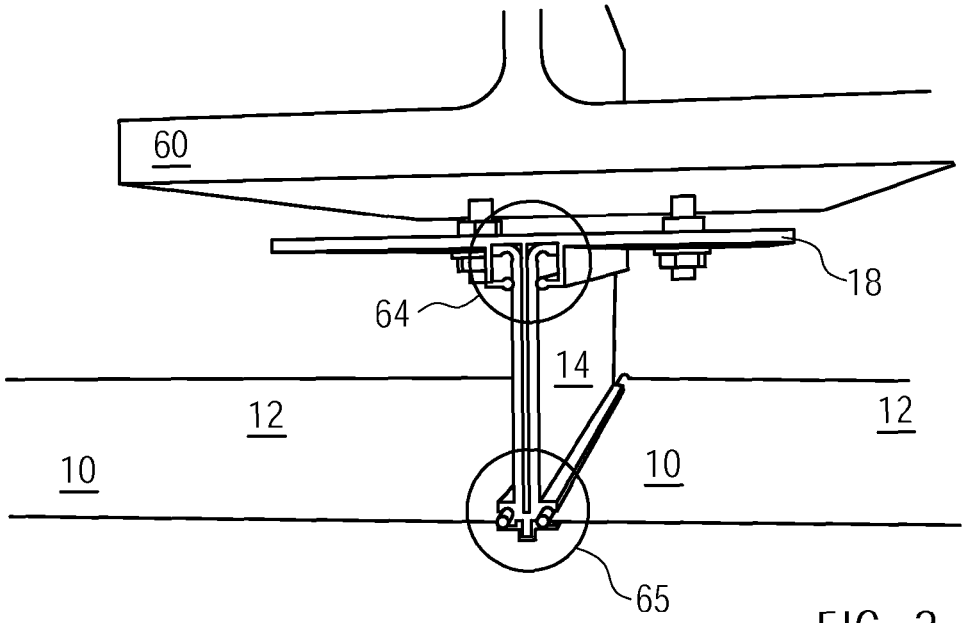

FIG. 3 Another perspective partial view of the embodiment of FIG. 1 with mounted covering rail.

Figure 4:
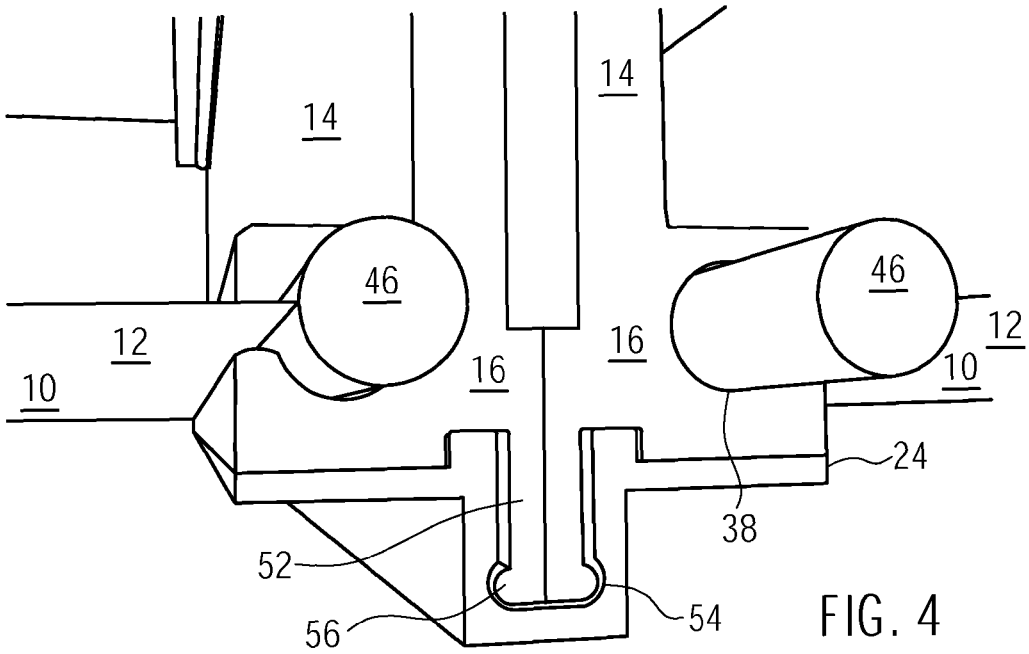

FIG. 4 A perspective partial view of the area defined by a circle 64 in FIG. 3.

Figure 5:
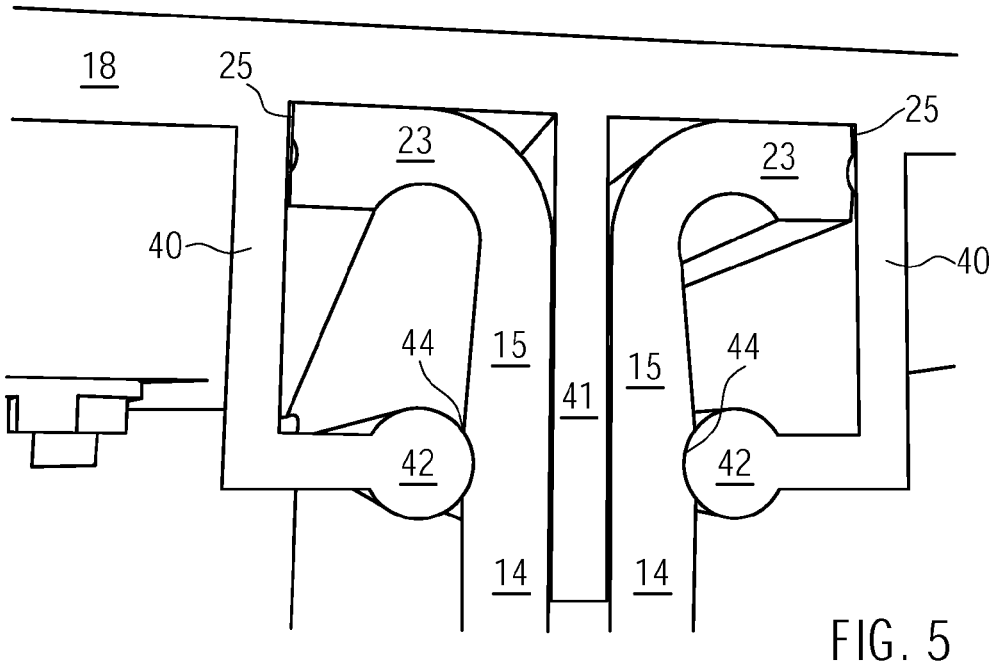
Figure 6:
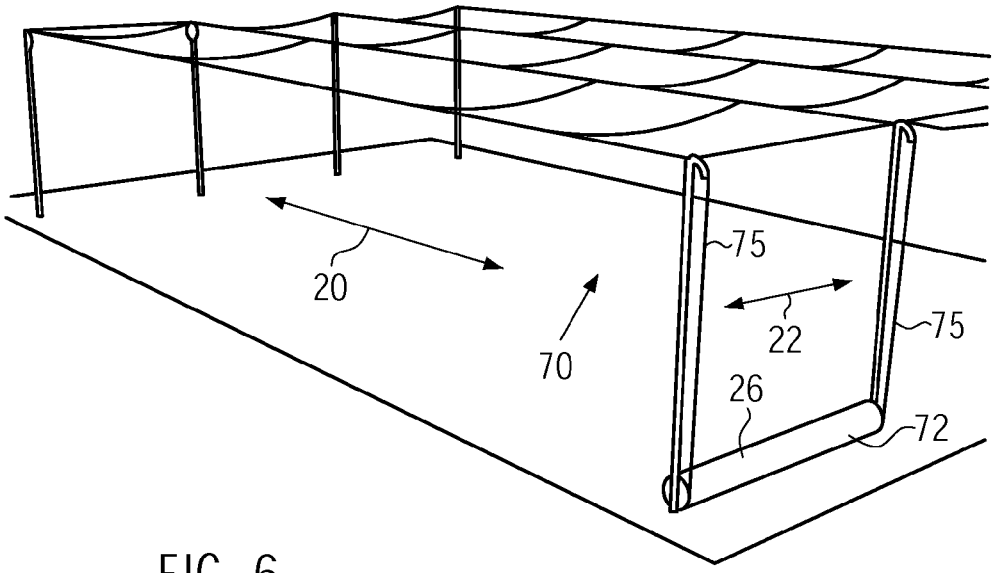

FIG. 5 A perspective partial view of the area defined by a circle 65 in FIG. 3.

FIGS. 6 to 10 Perspectives, diagrammatic views of different stages in performing the inventive method for lining a roof with a textile material.

FIGS. 11 to 16 Perspective partial views of different stages of performing the inventive method for lining a corner region.

Figure 17:
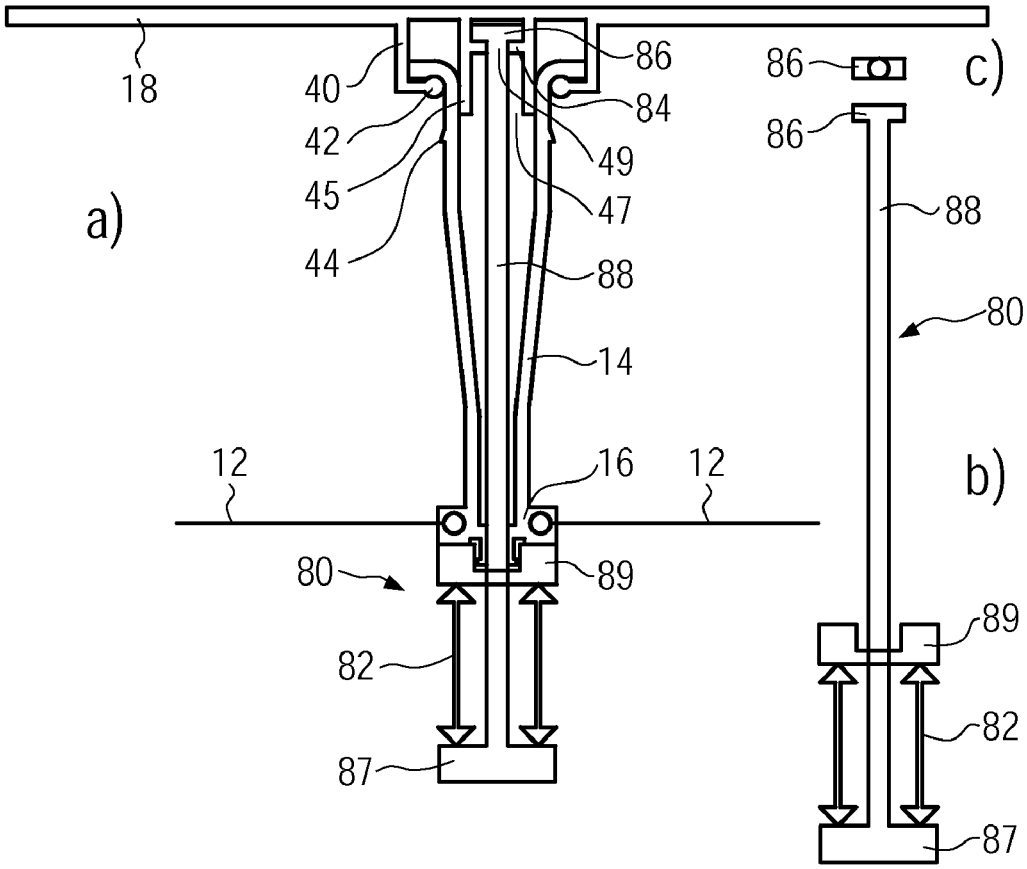

FIG. 17 In different sectional view a second embodiment of an inventive lining with a first variant of a forcing in tool for the stretching rails.

Figure 18:
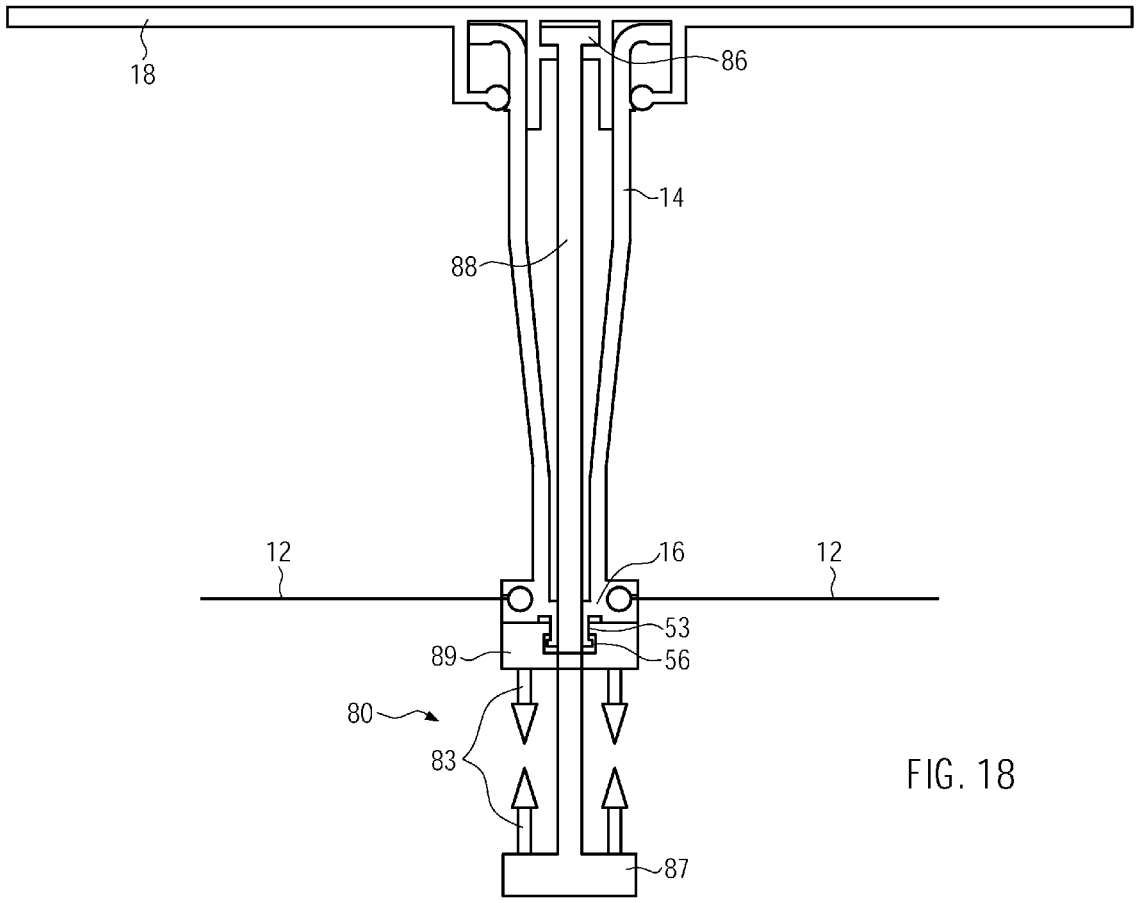

FIG. 18 A sectional view of the second embodiment of the inventive lining of FIG. 17 with a second variant of the forcing in tool for the stretching rails.

The fundamental ideas and essential component of the invention will be explained relative to FIGS. 1 to 5, where an essential element of the inventive lining is shown. For identical components the same reference numerals are used throughout the drawings.

As the essential constituent the inventive lining firstly has a plurality of holding rails 18, whereof only one is shown in exemplified manner in each of FIGS. 1 to 3. These holding rails 18, which can also be called fixing profilings, can be fixed directly to the surface to be lined, e.g. a ceiling, or can be integrated into the same. In the example shown, the holding rail 18 is fixed to a T beam 60 by means of an elongated hole 19 and screw coupling 21 and this is in turn placed below a not shown ceiling. Centrally on the holding rail 18 are provided roughly symmetrically positioned, bent and resilient legs 40 and a middle leg 41, between which are pivotably received stretching rails 14 with a holding side 15, cf. FIG. 5. FIG. 1 shows said stretching rails 14 in two different, widely swung apart states and in a stretching position, where the stretching rail 14 is positioned transversely, i.e. substantially perpendicular to holding rail 18 and the crosspiece of T beam 60. Over the entire circumference of a material piece 12, i.e. both on the longitudinal and transverse edges, are used stretching rails 14 for the stretching of material piece 12.

On an assembly side 16 each of the stretching rails 14 has an annular groove 38 in which can be received welt 46 of a material piece 12 of a covering material 10. The welt 46, which in the example shown is formed from an elastic plastics material extendable in the same way as the covering material 10, is in back engagement with the annular groove 38, so that the connection between covering material 10 and the assembly side 16 of stretching rail 14 is tensile loadable and the covering material 12 can be stretched by pivoting stretching rail 14.

FIG. 1 also shows that two stretching rails 14 are received symmetrically in holding rail 18 and are back to back in the stretching position. For optical covering and mechanical fixing a cap-shaped covering profile 24 can be inverted over resilient legs 52 formed on the assembly side 16 of stretching rails 14. As is shown in detail in FIG. 4, by noses or bulges 56 formed on the end regions of legs 52 and corresponding recesses 54 in covering profile 24, a locking engagement of covering profile 24 is made possible. The covering profile 24 can in particular absorb tensile forces of covering material 10.

In the situation shown in FIG. 1 a material piece 12 of covering material 10 is introduced or threaded into the stretching rail 14 pivoted out shown on the left side in FIG. 1. On both sides, i.e. also on the facing side not shown here, the material piece 12 is threaded into a stretching rail. The stretching rails 14 pivot as a result of the tension exerted by material piece 12. By folding back the material piece 12, whose size is "compensated", i.e. chosen slightly smaller than the surface to be covered, undergoes a stretching effect. Preferably the length extensions of the material piece 12 are roughly 1% smaller than the surface to be covered.

FIG. 2 shows a situation in which two adjacent stretching rails 14 are pivoted into the stretching position, i.e. substantially transversely to holding rail 18 and are locked in non-rotary manner and are namely snapped in there. Both material pieces 12 are stretched. A covering profile 24 can be mounted. In principle, unilateral stretching is also possible with fixing by forcing the stretching rail 14 into holding rail 18. However, in the example shown there is stretching on two facing sides. FIG. 3 shows the inventive lining in the completed state.

This rotation-fixed locking is explained relative to FIG. 5, where the ends of the holding side 15 of stretching rails 14 as well as a part of holding rail 18 are shown. Both stretching rails 14 are provided there with a bend 23, whose ends in each case form a stop 25. These stops 25 abut on the legs 40 of holding rail 18 on the inside and are supported there. As in each case bulges 42 are also formed on the bends of legs 40 and which engage in the corresponding recesses 44 in stretching rails 14, the latter in the situation shown in FIG. 5 are received altogether in rotation-fixed manner in holding rail 18. In the embodiment shown here this state is brought about by forcing up and subsequent locking of the stretching rails 14 in the holding rail 18. The bending moments and transverse forces resulting from a possible elastic bracing of the covering material and vertical loads, resulting from the own weight of the covering material 10, from the stretching rails 14 and holding rail 18 are absorbed in a stretching box of holding rail 18. The stretching box is the area of holding area 18 embraced by legs 40 into which the stretching rail 14 is forced up and where said stretching rail is locked. The already rotation-fixed stretching position of stretching rail 14 is fixed by forcing up the cap-shaped covering profile 24, which is shown in the removed state in FIG. 2. FIGS. 3 and 4 show the covering profile 24 in the mounted or locked on state.

Below, the novel assembly concept is described in detail with reference to FIGS. 6 to 10 using an example in which a roof structure 70 is lined.

Initially, in preparation, the stretching rails 14, for better clarity not shown in detail in this fig., are fitted by means of also not shown holding rails 18 to the roof structure, which can e.g. comprise poles and retaining straps. Furthermore, a membrane bale, i.e. a roll 72 with a web 26 of a textile covering material 10 is suitably positioned on a rack which has a rotable bearing. The web 26 in made in compensated manner, i.e. is produced reduced by the amount of the stretching lengthening effects. Finally, a threading device with cable 75 e.g. steel cables, which can also be referred to as threading cords, a threading funnel not shown in detail and suitable winches are installed.

In a second phase the web 26 of the textile covering material 10, each provided on its longitudinal side edges with welts, as explained hereinbefore relative to FIGS. 1 to 5, is drawn into the annular grooves of the already fitted, but still pivotable stretching rails 14. The annular grooves are also called welt profiles. The drawing in of the web 26 can take place without significant force expenditure, because the web 26 sags loosely in unstretched manner. To this end a threading cord is drawn through the welt profile and wound onto the winches.

Figure 7:
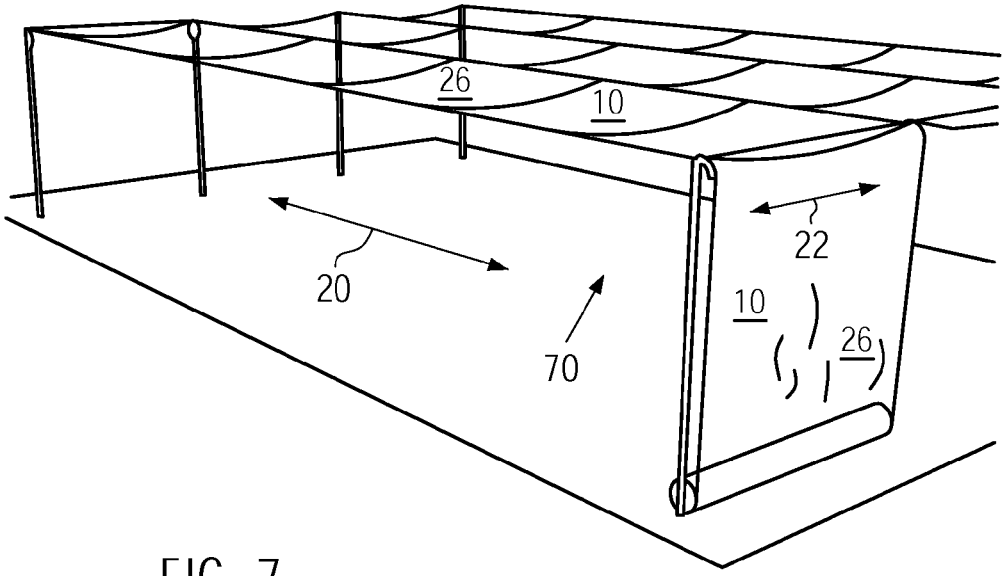
Figure 8:
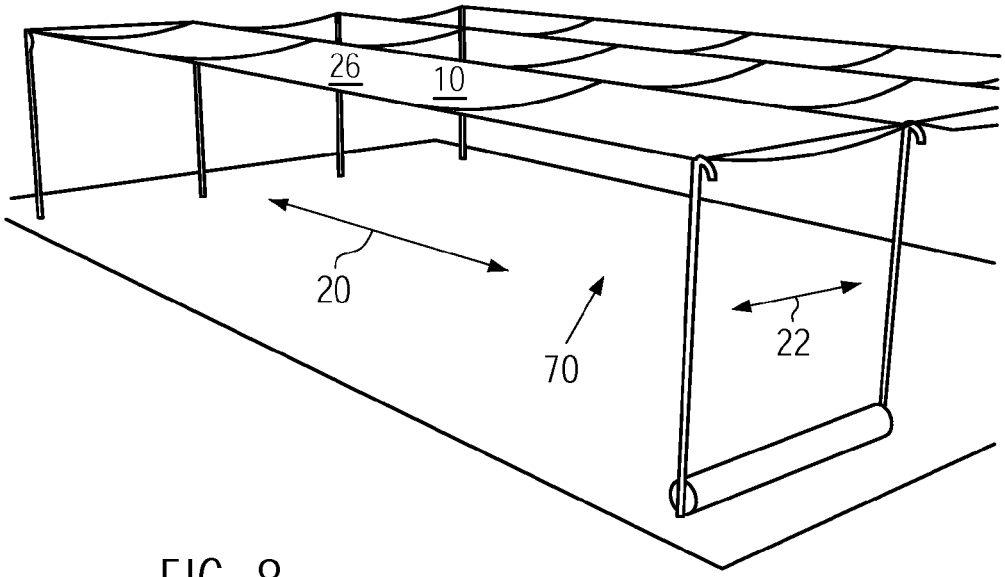
Figure 9:
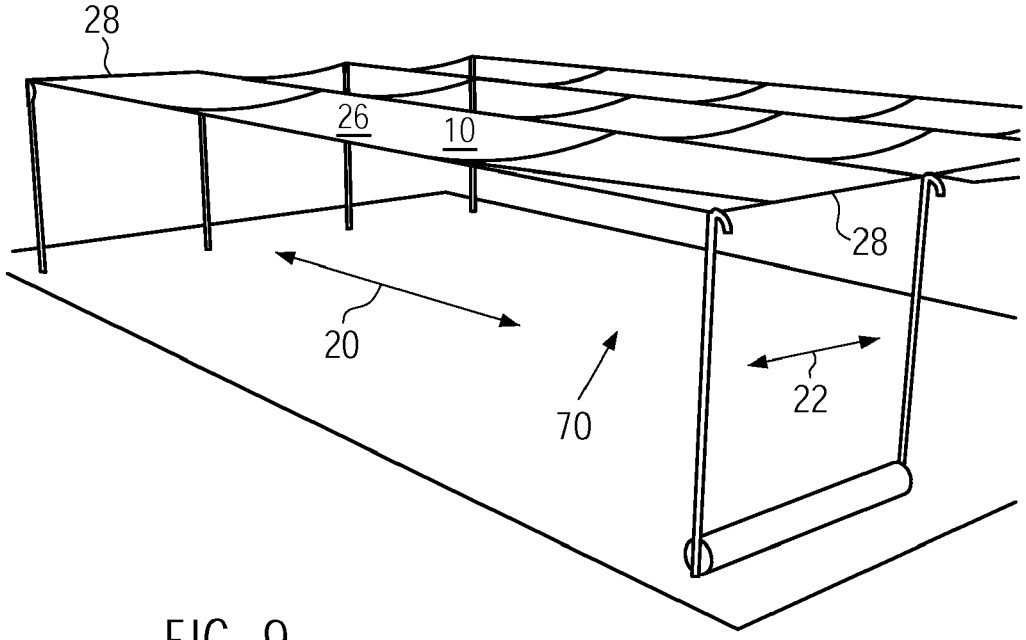

In the situation shown in FIG. 7 web 26 is already drawn in by roughly ⅗ of the entire distance in the longitudinal direction 20. FIG. 8 shows the state in which web 26 has been drawn in completely over the entire length, but still hangs loosely in the freely pivotable or rotatable stretching rails. The device for threading web 26 can now be disassembled. In the following phase shown in FIG. 9, web 26 is stretched in the longitudinal direction indicated by double arrow 20. Web 26 is also fixed to the front faces 28 with the aid of the stretching rails 14 provided there. Stretching and fixing take place in a single operation. Since, as described hereinbefore, the welts on the edges of web 26 are elastic, because said welts also slide loosely into the annular grooves and because screw or other clip connections are not present, the stretching process is not impeded and can therefore be easily and uniformly performed. In particular, without additional further means the web 26 can be held in a desired position.

To conclude the stretching process there is a stretching and fixing in the transverse direction indicated by double arrow 22. For this purpose the longitudinal side stretching rails are pivoted and afterwards forced into the stretching position. Pivoting can e.g. take place using suitable tools, namely collets. Using such collets it is also possible to simultaneously perform the stretching process for two adjacent edges, so that rapid and continuous working is made possible.

Figure 10:
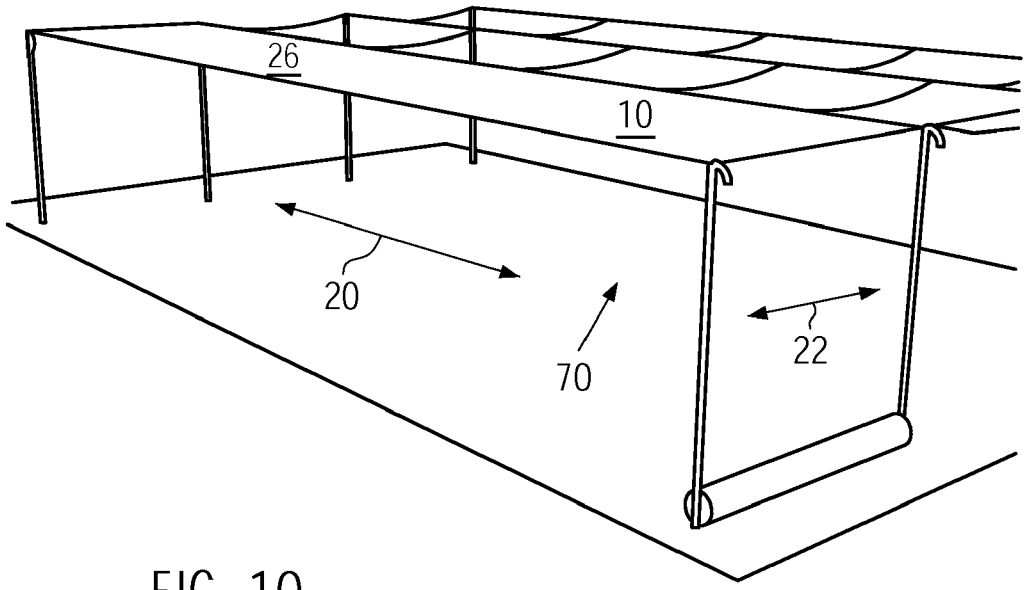

FIG. 10 shows the web 26 stretched and fixed in longitudinal direction 20 and transverse direction 22. As described hereinbefore, covering profiles 24 can then be forced or locked on.

The method permits rapid fitting and is therefore very cost-effective. The positioning and biaxial stretching and also the fixing are implemented by a single element, namely the novel stretching rail. The membrane areas are geometrically virtually perfect and tolerances are compensated in a very simple manner. The joints or butt joints of adjacent material pieces or membrane areas are very narrow and are optically unimportant.

With reference to FIGS. 11 to 16 the performance of the lining or the stretching process in corner region, in which an end side 28 and a longitudinal side 30 abut with one another is described. FIGS. 11 to 16 show such a corner region in perspective views from below, respectively. These drawings use the same reference numerals for identical components.

Figure 11:
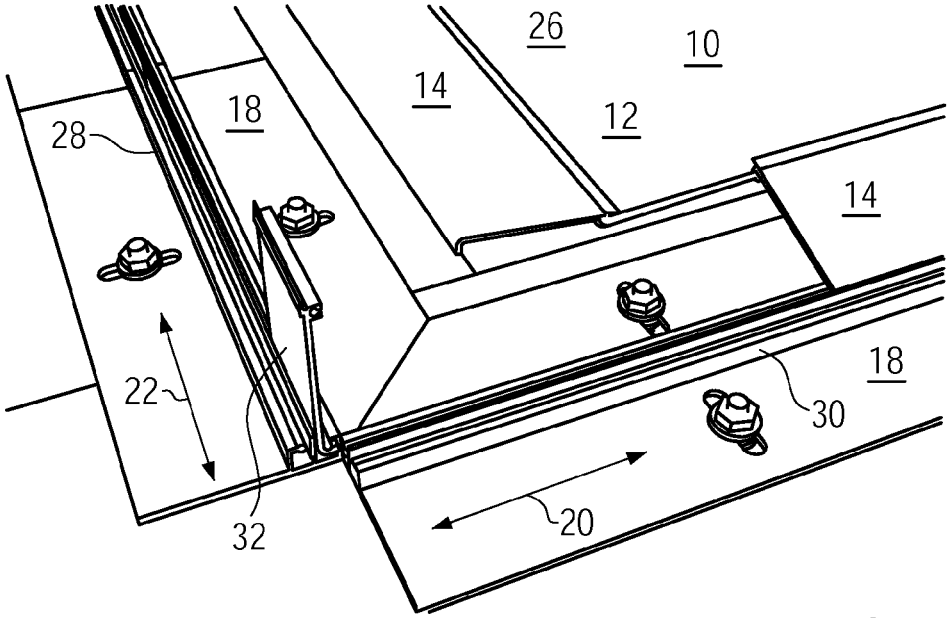

The starting state is the situation shown in FIG. 11. The material portion 12 to be stretched is received from the outset with a stretching rail 14 which is still not engaged in a holding rail 18 on an end side 28, which can also be called the transverse side. The material piece 12 of covering material 10 is once again a web 26. Thus, the stretching rail 14 is introduced from the outset in material piece 12, which has on its end face a frontal welt 34. Moreover, in the starting situation shown in FIG. 11 the threading of web 26 into stretching rail 14 on longitudinal side 30 is concluded in the right-hand area. However, on the longitudinal side 30 the stretching rail 14 is still pivotable and sags slightly at least to the extent allowed by web 26.

Figure 12:
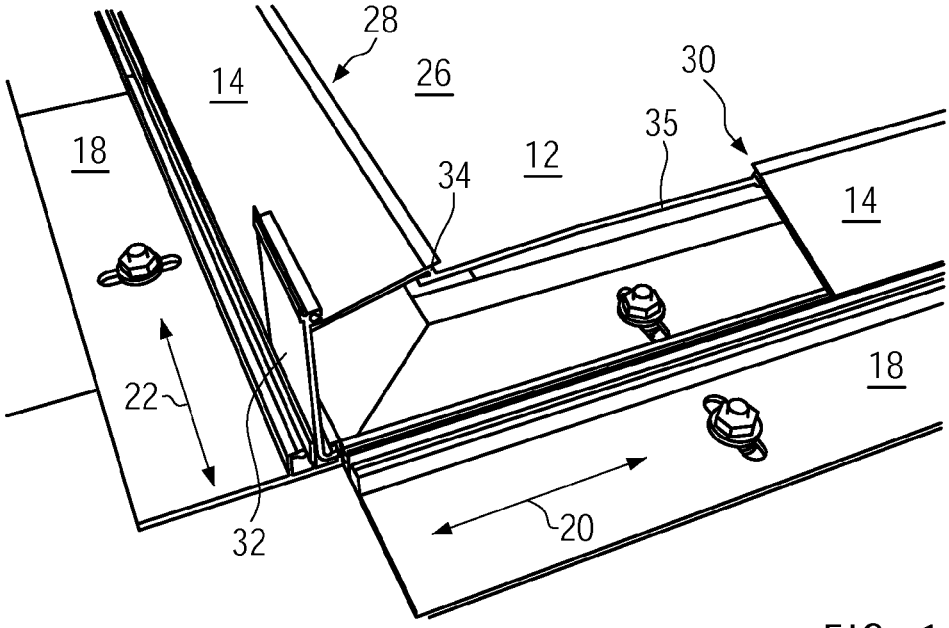

In the next operation the stretching rail 14 is inserted or hung on end face 28 in holding rail 18 and there part of the stretching takes already place there. The longitudinal side welt 35 is loosely located in annular groove of the stretching rail 14. By pivoting stretching rail 14 on end side 28 pretensioning now takes place in the longitudinal direction 20. Thus, the stretching process commences in the longitudinal direction 20 and this phase is shown in FIG. 12. Both stretching rail 14 on end side 28 and also stretching rail 14 on longitudinal side 30 are still pivotable there. FIG. 12 also shows that on the longitudinal side 30 in the direct corner region part is still free, i.e. without stretching rail 14. In the direct corner region of end side 28 a frontal stretching rail portion 32 is already inserted in holding rail 18 and is located there in the above-described rotation-fixed stretching position. The width of the area remaining free on longitudinal side 30 is dependent on the given geometrical circumstances.

Figure 13:
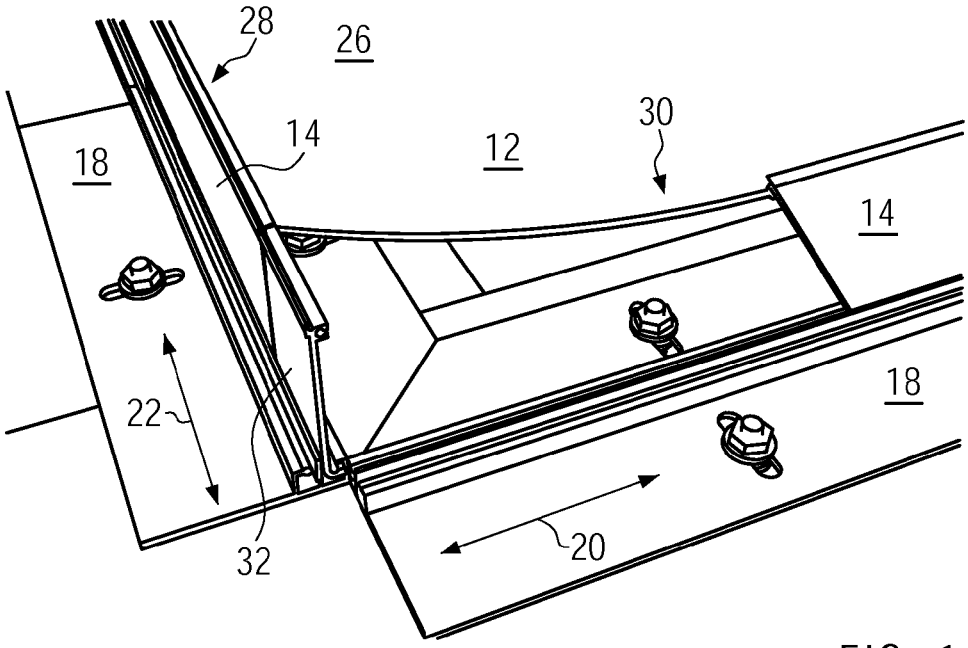

The stretching of web 26 in longitudinal direction 20 is then concluded by pivoting stretching rail 14 on end side 28. This situation is shown in FIG. 13. The material piece 12 is now uniaxially stretched in longitudinal direction 20. Stretching rail 14 on end side 28 is forced there into holding rail 18 and now transmits stretching forces.

Figure 14:
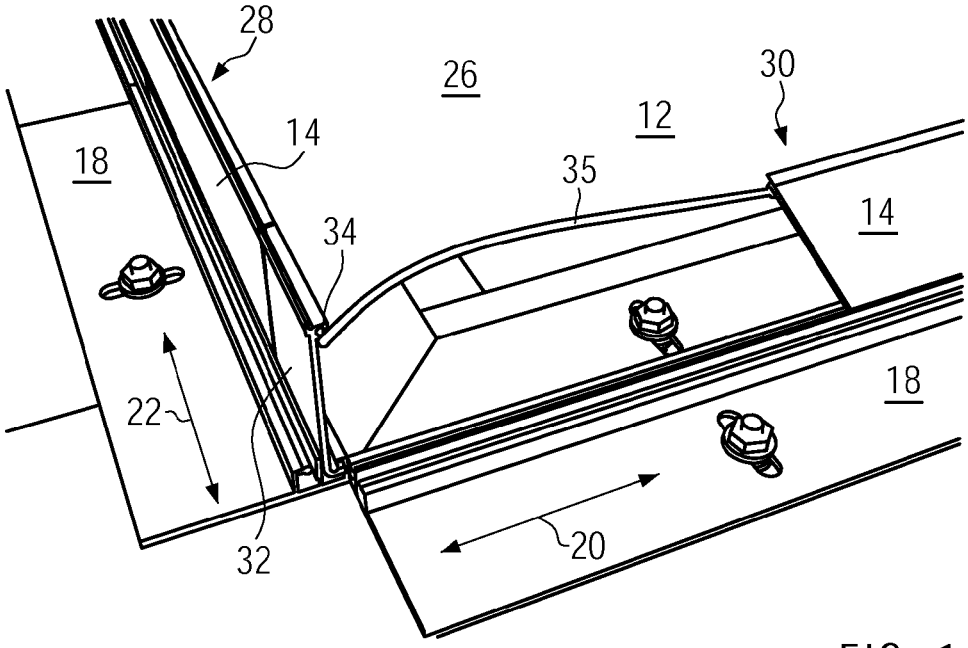

In a next stage shown in FIG. 14, now the web 26 is firstly only locally stretched in tranverse direction 22 on the edge of front side 28. There, the frontal welt 34 is introduced or threaded into the frontal stretching rail portion 32 and is held by the same.

Figure 15:
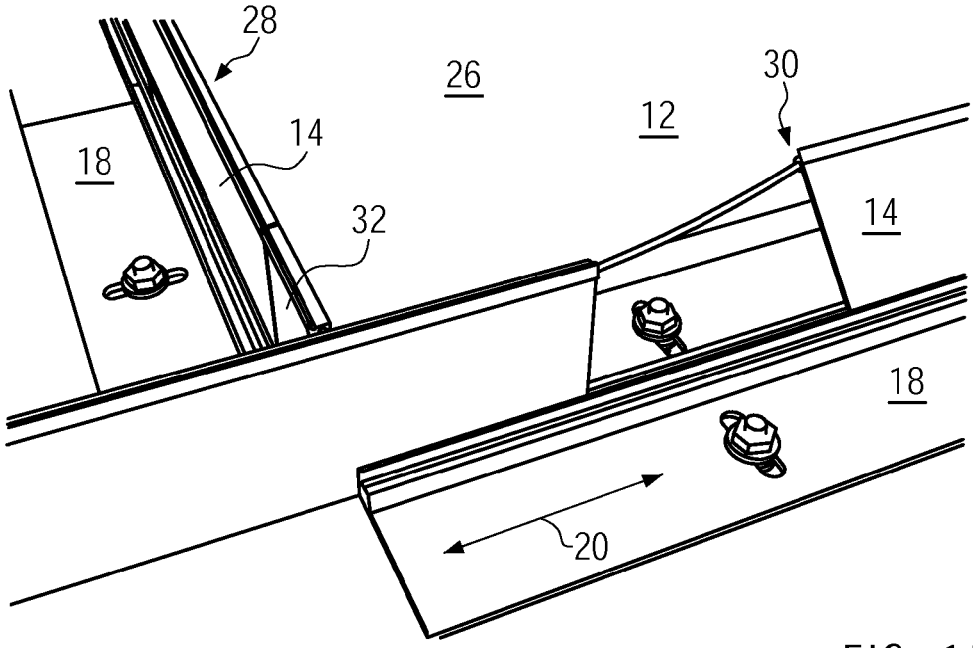

To conclude the stretching process illustrated in FIG. 15, a longitudinal side stretching rail portion 36 is introduced into the holding rail 18 existing on longitudinal side 30. In doing so, the longitudinal side welt 35 slides into the longitudinal side stretching rail portion 36. In this case of the threading of the longitudinal side stretching rail portion 36 in the longitudinal direction 20 stretching rail 14 is pivoted or twisted on longitudinal side 30 in gradual manner into a vertical position and web 26 is also stretched in the transverse direction 22.

Figure 16:
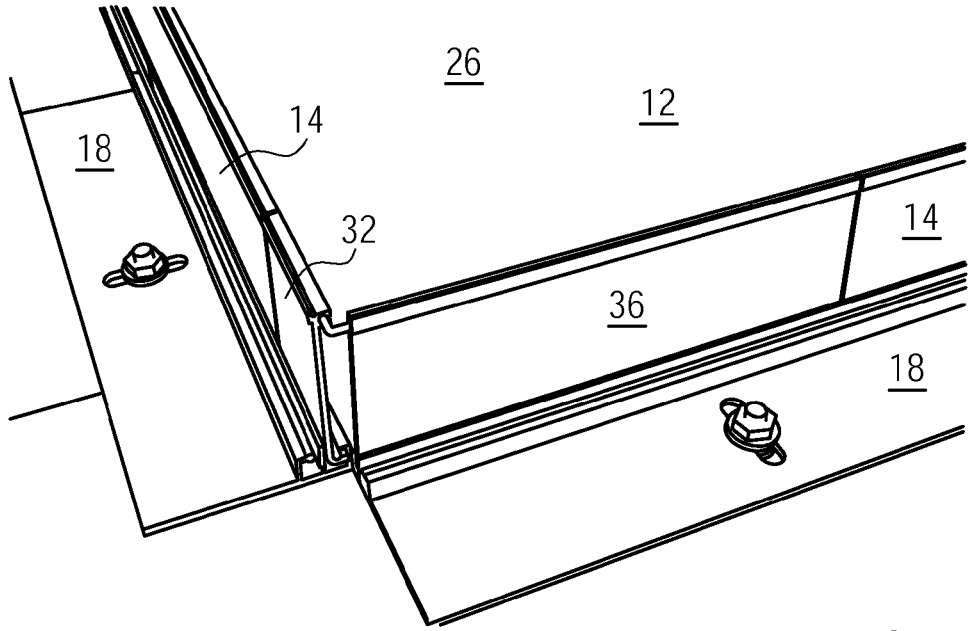

When all the stretching rails 14 have been pivoted in longitudinal direction 20 and transverse direction 22, they are forced into the respective holding rails 18 and are then in the stretching position. As shown in FIG. 16, the web 26 is now perfectly biaxially stretched.

By means of FIG. 17 an alternative embodiment of a holding rail 18 is explained and in conjunction with an also there shown tool 80 is made possible for a user a force-free pressing of the stretching rails 14 into the rotation-fixed stretching position. In a sectional view FIG. 17*a*) show a holding rail 18 with two stretching rails 14 received back to back and which are admittedly already pivoted to the maximum, so that material pieces 12 are stretched, but which are still not pressed in for achieving the rotation-fixed stretching position into holding rail 18. The components of the resilient legs 40, the bulges 42 formed there and the corresponding recesses 44 formed in stretching rails 14 are in accordance with the previously described embodiment.

Unlike in the first-described example, in the variant shown in FIG. 17*a*) the profile is modified. There is a double leg 45 forming a central groove 47 in place of a single central leg and on it is formed an abutment 84 having a passage 49. The abutment 84 cooperates in the subsequently described manner with a forcing in tool 80, which enables a user to press the stretching rails 14 in force-free manner into the holding rails 18.

This forcing in tool 80 is shown in a longitudinal sectional view in FIG. 17*b*) and c). The forcing in tool 80 essentially comprises a tie rod 88, on whose end are firmly arranged on the one hand a hammerhead 86 and on the other hand a bracket plate 87. There is also provided a support block 89 movably placed with respect to the tie rod 88 and which can be displaced with the aid of pressing device 82 illustrated diagrammatically by double arrows. The pressing device 82 can e.g. be a pneumatic or hydraulic plunger, a suitable spindle or also an electromechanical or exentric-equipped drive. For forcing in the stretching rails 14 the forcing in tool 80 with its hammerhead 86 is firstly introduced into the central groove 47 and then through passage 49 into holding rail 18. The head is then rotated by 90°, so that said hammerhead 86 is now supported an abutment 84. The pressing in forces are now directly short-circuited by abutment 84 in holding rail 18. As shown in FIG. 17*a*) likewise diagrammatically, the suitably formed bearing block 89 embraces the stretching rails 14 on the assembly side 16 thereof. Now, with the aid of the pressing device 82 the distance between the bearing block 89 and the bracket plate 87 provided on the lower end of tie rod 88 can be increased. Thus, stretching rails 14 are forced into holding rails 18 without forces acting to the outside. This is particularly advantageous if a fitter must stand on a mechanically unstable substrate, e.g. on a non-rigid or wobbly lift vehicle or ladder and is not or should not be able to apply high forces.

If the bearing block 89 and the ends of the stretching rails 14 on the assembly side 16 thereof are suitably shaped and can be engaged with one another in a supporting, particularly positive manner, said process can also be reversed, i.e. used for the force-free drawing out of stretching rails 14, so that a removal of an already fitted membrane area or material piece is made possible. With the stretching rails forced in, the forcing in tool is introduced, the stretching rails are positively embraced by a bearing block of the forcing in tool and the rod is forced with the hammerhead against the holding rail, so that in externally force-free manner drawing can take place on the stretching rails for drawing out the latter.

A second variant of the forcing in tool in which a drawing out, i.e. disassembly of the stretching rails is possible, is illustrated in FIG. 18. The lining shown there corresponds to the embodiment of FIG. 17 and in FIG. 18 the stretching rails 14 are shown in the state forced into holding rail 18 and forcing in tool 80 is inserted. However, there are differences in connection with the forcing in tool 80, or more precisely in the area of bearing block 89. In the example shown said bearing block is constructed for back engagement with the assembly side 16 of a pair of stretching rails 14. The forcing in tool of FIG. 18 can therefore be referred to as a pressing-drawing tool. More precisely, the bearing block 89 has a suitably shaped profiling 53, which engages behind the bulges 56 formed on the resilient legs 52 of stretching rails 14. Reversing the process described relative to FIG. 17, the stretching rails 14 are consequently positively embraced by bearing block 89. The hammerhead 86 is then rotate, so that it can be moved out of holding rail 18. Through a drawing together of the forcing in tool 80, i.e. a movement of the bearing block towards the bracket plates 87, the stretching rails 14 can then be drawn out. This drawing together is illustrated by the double arrows 83. The drawing together can also be implemented with the variants referred to hereinbefore for pressing device 82.

The invention claimed is:

1. Method for lining a surface with a flexible covering material, in which the surface is lined with a material piece of the flexible covering material and in which the material piece is stretched, where for stretching the material piece, use is made of a plurality of stretching rails, each stretching rail including a holding side and an assembly side, wherein each stretching rail has a substantially flat and rectangular shape, where each stretching rail is brought into pivotable engagement on the holding side with one of a plurality of holding rails provided on the surface, where a first side of the material piece is brought into stretchable engagement with the assembly side of each stretching rail, where a second side of the material piece is directly or indirectly stretchably connected to the surface, and where each stretching rail for stretching the flexible covering material is pivoted into a stretching position in which a plane defined by each stretching rail is transverse to the surface to be lined and fixed in the stretching position by forcing each stretching rail into a holding rail, wherein the covering material is firstly stretched in a longitudinal direction and then in a transverse direction and wherein the material piece of the covering material during stretching in said longitudinal direction is displaced in at least one of the plurality of stretching rails fitted in said longitudinal direction, wherein for the outward, pressing in of the stretching rails into the holding rails, a pressing-drawing device is used, the pressing-drawing device being supported on an abutment provided in the holding rails and the stretching rails to be forced in, and /or for the outward, drawing out of the stretching rails from the holding rails use is made of the pressing-drawing device, the pressing-drawing device being brought into a back engagement with the stretching rails for drawing out purposes.

2. Method according to claim 1, wherein in the longitudinal direction, the covering material is drawn into each stretching rail prior to the pivoting.

3. Method according to claim 2, wherein a cable is used for drawing in the covering material.

4. Method according to claim 1, wherein the material piece is made of a web of covering material.

5. Method according to claim 1, wherein the stretching rails are provided on at least two facing sides of the material piece.

6. Method according to claim 1, wherein, with respect to length and width, the material piece is in each case dimensioned to be 1 to 5% smaller than in the lengthened installation state.

7. Method according to claim 1, wherein the covering material comprises a textile material.

8. Method according to claim 7, wherein the textile material comprises a lighting material.

9. Method according to claim 1, wherein for stretching material piece in a corner region where a front side and a longitudinal side abut with one another, the following method steps are performed:

frontal fitting of a frontal stretching rail portion, stretching the material piece in longitudinal direction, stretching the material piece in transverse direction, where a frontal welt of the material piece slides into the frontal stretching rail portion and completing a lining of the corner region by inserting a longitudinal side stretching rail portion following stretching in transverse direction.

10. Method according to claim 1, wherein, with respect to length and width, the material piece is in each case dimensioned to be 1% smaller than in the lengthened installation state.

11. Method according to claim 1, wherein stretching rails are provided on all sides of the material piece.

12. Lining of a surface, the lining comprising:

a flexible covering material, a plurality of stretching rails for stretching the covering material, each stretching rail including a holding side and an assembly side, wherein each stretching rail has a substantially flat and rectangular shape, where each stretching rail can be brought into pivotable engagement by the holding side with a holding rail provided on the surface, where each stretching rail can be fixed in a stretching position relative to the holding rail, where for a provision of a stretchable back engaging connection of the covering material to the stretching rail a material piece of the covering material is provided with a welt and each stretching rail is provided on the assembly side with a corresponding groove, where a second side of the material piece is directly or indirectly brought into a stretchable engagement with the surface and where by pivoting each stretching rail and fixing each stretching rail in a stretching position a stretching state of the flexible covering material can be achieved, wherein for permitting a bi-dimensional stretching of the covering material, the welt and the groove are formed in such a way that the welt can be longitudinally displaced in the groove and wherein a covering profile is provided for a connection of two adjacent stretching rails of the plurality of stretching rails arranged back-to-back in the stretching position, which can be fixed in a locking manner to the two stretching rails in the stretching position, the covering profile fixing the two adjacent stretching rails in the stretching position.

13. Lining according to claim 12, wherein the material piece is a web.

14. Lining according to claim 12 or 13, wherein, with respect to length and width, the material piece is in each case dimensioned to be 1 to 5% smaller than in the lengthened installation state.

15. Lining according to claim 12, wherein the welt is formed from a flexible material.

16. Lining according to claim 12, wherein each holding rail is constructed for adjacent reception of two stretching rails.

17. Lining according to claim 12, wherein the stretching rails and the holding rail are designed for a locking, rotation-fixed connection.

18. Lining according to claim 17, wherein for providing the locking, rotation-fixed connection the holding rail has at least one resilient leg with a bulge and the stretching rails are provided with a correspondingly shaped recess and the locking, rotation-fixed connection of each stretching rail can be brought about by pressing the stretching rail transversely to a pivoting axis.

19. Lining according to claim 12, wherein the plurality of stretching rails are provided on at least two facing sides of the material piece.

20. Lining according to claim 12, wherein the stretching rails are constructed for uniformly spaced holding of the covering material relative to the surface.

21. Lining according to claim 12, wherein the plurality of stretching rails are provided over the entire length of material piece.

22. Lining according to claim 12, wherein the stretching rails comprise a lightweight metal.

23. Lining according to claim 12, wherein the holding rail includes an abutment for an outward, pressing in of stretching rails and by means of which a pressing device of a forcing in tool can be brought into a supporting back engagement.

24. Lining according to claim 12, wherein the assembly side of each stretching rail includes a profiling with which a pressing-drawing tool can be brought into back engagement for drawing out the stretching rails.

25. Lining according to claim 24, wherein the profiling comprise a bulge.

26. Lining according to claim 12, wherein, with respect to length and width, the material piece is in each case dimensioned to be 1% smaller than in the lengthened installation state.

27. Lining according to claim 12, wherein the flexible covering material comprises a textile material.

28. Lining according to claim 12, wherein stretching rails are provided on all sides of the material piece.

29. Lining according to claim 12, wherein the groove comprises an annular groove.

30. Lining according to claim 12, wherein the flexible material of the welt comprises a strand or a plastic wire.

* * * * *